United States Patent [19]

Siegel

[11] B 4,000,768

[45] Jan. 4, 1977

[54] HANDLE PACKAGE

[75] Inventor: Karl-Heinz Siegel, Nurnberg, Germany

[73] Assignee: Minigrip, Inc., Orangeburg, N.Y.

[22] Filed: Apr. 16, 1974

[21] Appl. No.: 461,250

[44] Published under the second Trial Voluntary Protest Program on March 16, 1976 as document No. B 461,250.

[52] U.S. Cl. ..... 150/3; 150/12; 229/54 R; 223/87

[51] Int. Cl.[2] ..... A45C 13/26; B65D 33/06; B65D 33/24

[58] Field of Search ..... 150/3, 12; 229/54, 62; 248/339, 340; 223/85, 87

[56] References Cited

UNITED STATES PATENTS

| | | | |
|---|---|---|---|
| 3,452,922 | 7/1969 | Hart | 229/54 R |
| 3,458,093 | 7/1969 | Bacharadi | 223/87 |
| 3,459,348 | 8/1969 | Masson | 223/87 |
| 3,509,927 | 5/1970 | Hasty | 150/3 |
| 3,568,918 | 3/1971 | Blomquist | 150/12 |

FOREIGN PATENTS OR APPLICATIONS

| | | | |
|---|---|---|---|
| 2,105,811 | 8/1971 | Germany | 150/12 |

*Primary Examiner*—William Price
*Assistant Examiner*—Ro E. Hart
*Attorney, Agent, or Firm*—Hill, Gross, Simpson, Van Santen, Steadman, Chiara & Simpson

[57] ABSTRACT

A hang-up container made from thermoplastic synthetic material has a bag or sack body attached to a separable fastener comprising extruded pressure- slide- or push-fastener strips one of which has an upwardly extending reinforced carrying portion which may be provided with a reinforcing bead therealong at juncture with its closure portion and which has attached thereto an upwardly extending hook/handle. Bag type containers as thus described are especially adapted to be produced in an automatic production machine wherein body film material and the fastener strips are brought together and integrally welded, the prefabricated hook/handles are welded onto the carrying portions, the bags are successively separated along tear seals, and the separated bags carried away from the machine.

The hook/handle part may be provided with a handhole and an upwardly projecting hanger hook, or with a handhole into which a hanger bar entry slot extends at one side with a central hanger bar recess notch opening downwardly in the handle into the handhole.

4 Claims, 6 Drawing Figures

24
25
22
20
19
26
23

12
13
15
24
14
25
22
20
26
23
19
21

12
13
15
14
24
25
20
19
23
26
21

HANDLE PACKAGE

This invention relates to hang-up containers and is more particularly concerned with hang-up bags or sacks provided with separable fasteners and carrying and hang-up hook/handles.

Heretofore, there has been provided a method for the production of a closeable hang-up container consisting of a bag or sack provided with a hook and releasable pressure- slide- or push-closing fastener extruded in a pair of strips, according to which a tube or a double flat film made of thermoplastic synthetic material is endlessly extruded and subsequently is conveyed together with the fastener strips into an automatic machine where the fastener strips are connected with the flat walls of the tube or the double flat film by means of welding and the tube or the flat film and fastener assembly is divided by means of tear seals into individual bags or sacks. The resulting container has one closure strip in one piece on one side provided with a connecting strip extending downwardly in the plane of the bag or sack wall from a connecting line with the closure strip and is provided with a reinforced band area extending from the connection line upwardly. A carrier hook is stamped out of the reinforced band area.

According to the present invention a principal object is to produce containers of this type entirely automatically, but without waste of material and to provide such containers with carrying handle and hook means that may be used for all sizes of bags.

In solving the problem according to the present invention, a method is provided for producing a sealable hang-up container which may be in the form of a bag or sack with a carrying handle and hang-up hook and a releasable pressure- slide- or push-closure extruded in two strips and wherein a tube or double flat film of thermoplastic synthetic material is endlessly extruded and subsequently conveyed together with the closure strips to an automatic machine from which the closure strips with the flat walls of the film strips or tube or of the flat film are connected by welding and the completed container is divided by tear seals into individual bags or sacks. One of the closure strips is produced in one piece having a connecting strip extending downwardly with a closure strip in the plane of the attached container wall and a reinforced carrying band or web area extends upwardly from the connecting line, and to which a one-piece handle/hook is welded. Not only does this provide a desirable construction in which it is not necessary to have a double hook, but a one part hook is sufficient. The same size of hook may be used for all container sizes that may be desired. The handle/-hook parts can be produced by injection molding. Although the hook/handle part may have a handhole slot and an upwardly projecting hanger hook, it may also be provided in a form wherein handhole has an upper lateral entry-slot with a central hang-up rod receiving notch opening downwardly into the handhole laterally from the entry slot. This provides a space saving reduction in length of the container by elimination of an upstanding hook.

For heavy duty uses such as where heavier objects must be enclosed in the hang-up container, the invention provides a particularly advantageous feature in that the closure strip having the upwardly extending carrying area is provided with a reinforcing bead above the connecting line with the closure strip. Such bead is not a part of the carrying handle hook structure, but the reinforcing bead is extruded endlessly with the closure strip.

Other objects, features and advantages of the invention will be readily apparent from the following description of certain preferred embodiments thereof, taken in conjunction with the accompanying drawings although variations and modifications may be effected without departing from the spirit and scope of the novel concepts embodied in the disclosure, and in which.

Figure 1:
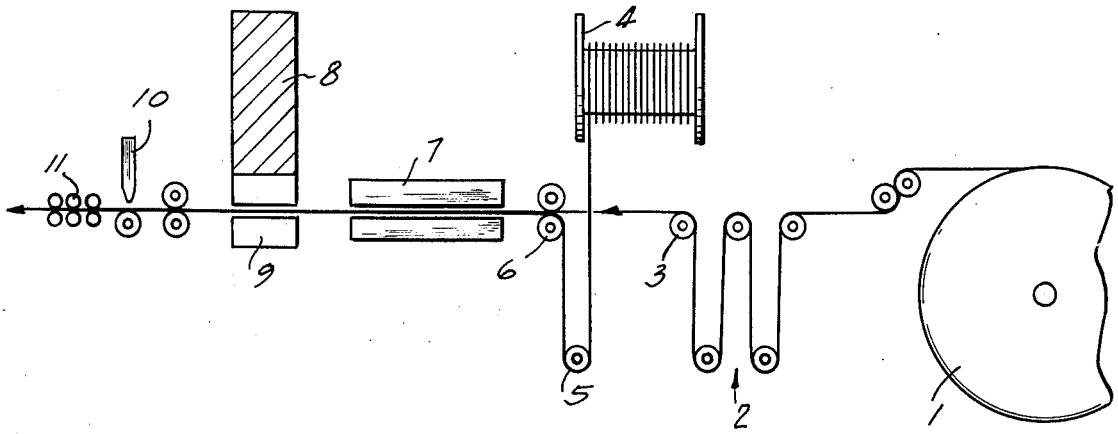
FIG. 1 is a diagrammatic illustration of apparatus for carrying out the method according to the present invention.

In a method of producing hang-up containers according to the present invention, as illustrated diagrammatically in FIG. 1, thermoplastic synthetic film material which may be in the form of an endlessly extruded flattened tube is supplied in a roll 1 from which the tube is fed through a set of rollers at a station 2. From there, the flattened tube is conducted to a slitter station 3 wherein the tube is slit open at one side edge in longitudinal direction.

Extruded thermoplastic synthetic separable pressure-slide- or push-closure strips are supplied endlessly on a roll 4 and are fed about a guide roll 5 and joined with the slit bag body material at a station 6. At a welding station 7, the two closure strips are permanently integrally welded to the flat walls of the film webs of the body tube. After attachment of the closure strips, the body tube is conveyed into position relative to a hook/-handle magazine 8 associated with a welding station 9 in which the hook-handles are successively welded permanently onto one of the closure strips of the container units. The container units now comprising the integral body tube, closure and hook/handle is then divided at a station 10 along tear seals into individual bags or sacks. The individual hang-up containers are then conveyed from the machine by way of a transfer belt conveyor 11.

Figure 2:
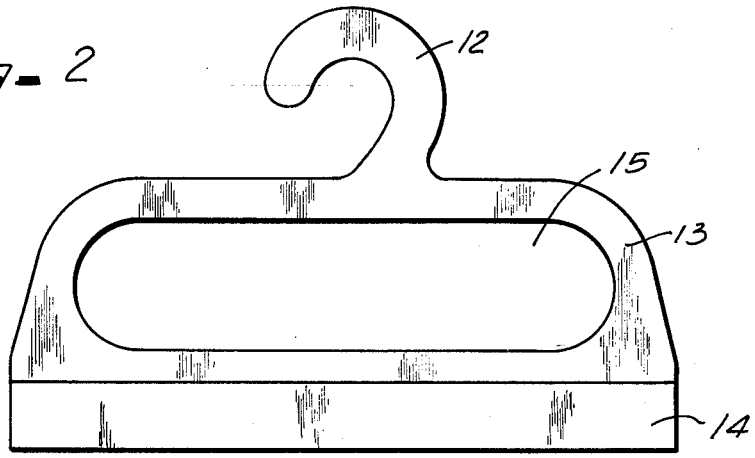
FIG. 2 is an elevational view of a hook/handle according to the present invention.

In one embodiment of the hook/handle structure, a hang-up or supporting rod engaging hook 12, as shown in FIG. 2 comprises a part in one piece with a carrying handle 13 provided on its opposite end from the hook 12 with a weld on strip or area 14 which is only slightly wider than handhole opening 15 of minimum length and width to receive a person's hand confortably and conveniently. This is advantageous in that one and the same size of hook/handle element can be used for all bag sizes that may be desired.

Figure 3:
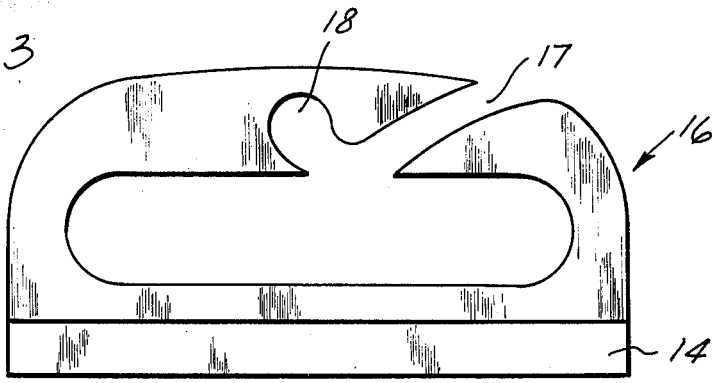
FIG. 3 is a topside elevational view of a modified embodiment of hook/handle according to the invention.

In the modification of FIG. 3, a hook/handle part 16 is shown which is also adapted to be made as an extruded or injection molded part, but which is substantially shorter than the part as shown in FIG. 2 because the part 16 does not have an upstanding hook, but the hook portion is integrated with the handle portion of the device. To this end, the hook-handle part 16 is provided with an upper diagonally laterally extending entry slot 17 in the handle portion above the handhole and leading to the entry end of a hook notch 18 which opens into the handhole and is adapted to receive a hang-up rod received through the slot 17 and then into the notch 18. Similarly as in FIG. 2, the lower margin of the member 16 is provided with a weld-on area 14.

Figures 4, 5, 6:
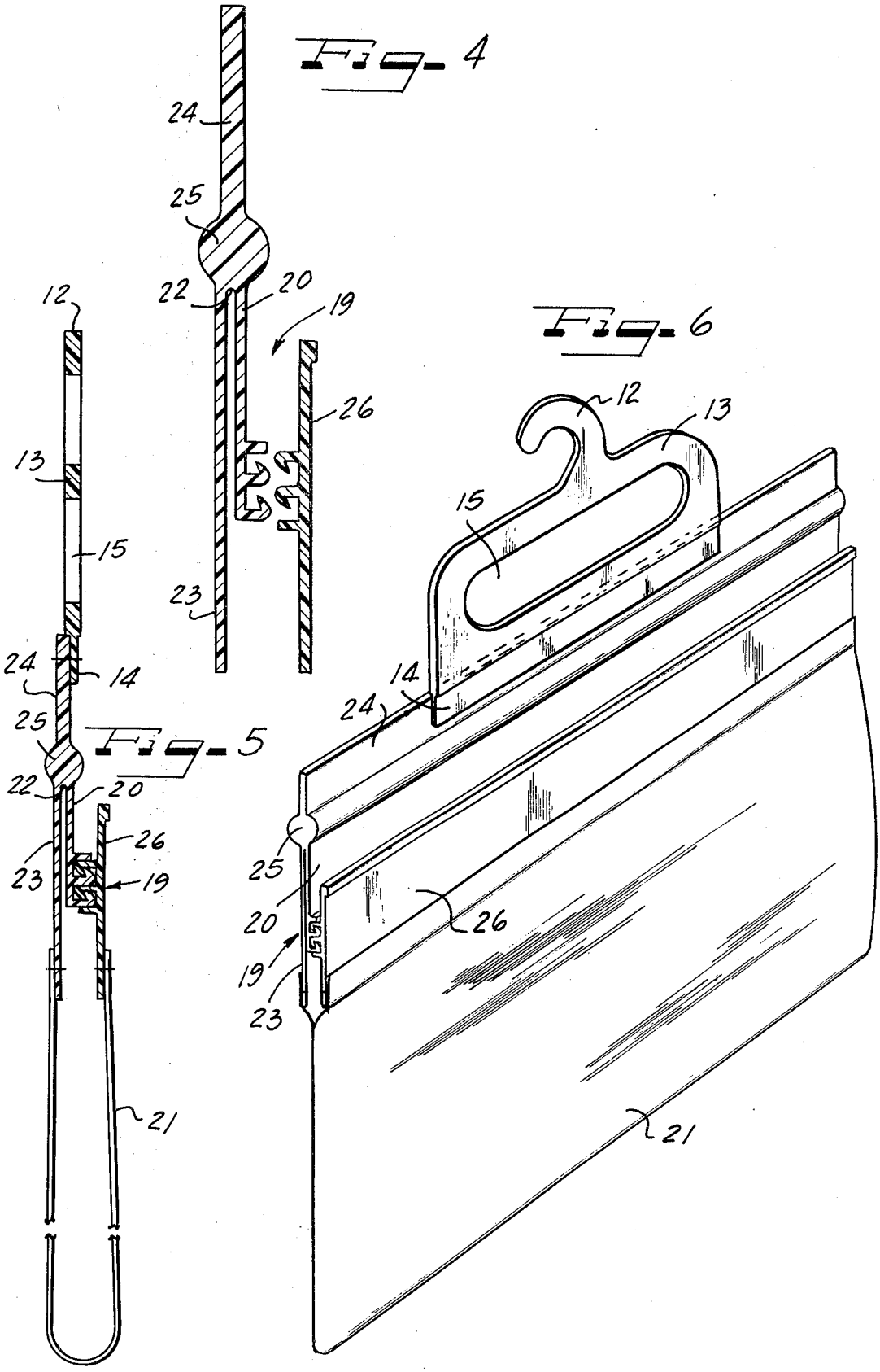
FIG. 4 is an enlarged vertical sectional view through a closure strip assembly according to the present invention.
FIG. 5 is a fragmental vertical sectional view through a hang-up container embodying features of and produced according to the present invention.
FIG. 6 is a perspective view of the container.

As shown in FIG. 4, the separable fastener or closure, generally identified at 19, comprises at one side a depending fastener strip 20 which is connected to one sidewall of a thermoplastic film bag body 21 by way of a connecting line or juncture 22 along the upper edge of the strip 20 from which extends an integral depending connecting or attachment flange or web 23 and which is welded to the bag body panel extending generally downwardly in a plane therefrom. Extending upwardly from the juncture 22 is an integral carrying band flange or web area 24 which extends the full length of the fastener, and thus the width of the bag, and is reinforced throughout by being of substantially greater thickness than the strip 20 or the coextensive attachment flange 23.

For heavy duty purposes, the carrying flange web area 24 is provided with an integral reinforcing bead rib 25 extending immediately above and along the juncture 22. This provides a desirable stiffness for the carrying web.

At the opposite side of the bag, a fastener strip 26 complementary to the fastener strip 20 is provided with the customary attachment flange or web portion which is welded to the associated side panel of the bag body 21.

In the completed bag, the selected form of hook/handle is permanently affixed centrally to the upstanding carrying flange web area 24 by weldng the attachment margin or weld area 14 thereto, as best seen in FIGS. 5 and 6. By having the hook/handle part of as narrow a width as practicable, and prefabricated as an injection molded or extruded part, the hook/handle part is adapted to be applied to bags which are as narrow as the hook/handle part itself, or of any preferred greater width. The horizontal reinforcing bead rib 25 assists in maintaining the bags of greater widths than the hook/handle portion against sagging at the sides.

I claim as my invention:

1. A closeable hand-up container including a separable extruded two strip fastener secured to thermoplastic film bag sidewall panels, each fastener strip having separable fastener means to engage closingly with the other, one of the fastener strips including an attachment web secured to one of the bag wall panels and having a carrying web area extending in the opposite direction from juncture of the attachment web and fastener strip, with a one piece handle part welded onto the carrying web area:

said handle part having a horizontally elongated handhole with an overlying hand grip portion provided with a central hanger-bar-receiving hook notch opening downwardly into the handhole;

an entry slot extending from the top of said grip portion to the bottom of said grip portion and generally aligned with the notch opening;

said hand grip portion having grip sections thereof at each side of said notch and said carrying web area having a extruded reinforcement bead rib integral therewith and extending therealong throughout its width adjacently above said juncture and below said handle part.

2. A hang-up container according to claim 1, wherein said handle part is substantially narrower than said carrying web area and centrally located thereon and projecting thereabove, and said carrying web area is stiffened by said rib to resist sagging at the opposite sides of said handle part.

3. A closeable hang-up container including a separable extruded two strip fastener secured to thermoplastic film bag sidewall panels, each fastener strip having separable fastener means to engage closingly with the other, one of the fastener strips including an attachment web secured to one of the bag wall panels and having a carrying web area extending in the opposite direction from juncture of the attachment web and fastener strip, with a one piece handle part welded onto the carrying web area, and comprising:

an extruded reinforcement bead rib integral with said carrying web area and extending therealong throughout its width adjacently above said juncture and below said handle part.

4. A hang-up container according to claim 3, wherein said handle part is substantially narrower than said carrying web area and is centrally located on the carrying web area and projects upwardly therefrom, and said carrying web area is stiffened by said rib to resist sagging at the opposite sides of said handle part.

* * * * *